United States Patent [19]

Marcus et al.

[11] 4,339,035

[45] Jul. 13, 1982

[54] DISPENSING PACKAGE FOR NIPPLE MARKERS

[76] Inventors: Robert Marcus, 8201 Henry Ave., Apt. M16, Philadelphia, Pa. 19128; Warren B. Gefter, 243 Wiltshire Rd., Wynnewood, Pa. 19151; Wallace T. Miller, 3105 Coulter St., Philadelphia, Pa. 19129

[21] Appl. No.: 217,781

[22] Filed: Dec. 18, 1980

[51] Int. Cl.[3] ..... B65D 5/72; B65D 85/671; G21F 3/00

[52] U.S. Cl. ..... 206/370; 206/390; 206/409; 206/820; 206/828; 250/515

[58] Field of Search ..... 206/363, 370, 390, 397, 206/409–411, 438, 440, 820, 828; 128/132 R, 150; 250/514–516; 428/41

[56] References Cited

U.S. PATENT DOCUMENTS

| | | | |
|---|---|---|---|
| 3,068,863 | 12/1962 | Bowman | 128/132 R |
| 3,078,183 | 2/1963 | Karalus | 206/818 |
| 3,267,623 | 8/1966 | Block | 206/390 |
| 3,371,400 | 3/1968 | Edes | 206/390 |
| 3,835,992 | 9/1974 | Adams | 206/390 |
| 4,060,168 | 11/1977 | Romagnoli | 206/390 |
| 4,165,807 | 8/1979 | Yagi | 206/409 |

OTHER PUBLICATIONS

"X-Ray Supplies", General Electric X-Ray Corp., 1932, p. 13.

*Primary Examiner*—Stephen Marcus
*Attorney, Agent, or Firm*—Kenyon & Kenyon

[57] ABSTRACT

Package for dispensing nipple markers for use in X-ray technology comprising a roll of base tape having successive pads releasably adhered thereto, each pad containing a lead disc for placing over the nipple of an X-ray patient. The roll is contained in a surrounding package and dispensable through a slit therein. The tape is severable to remove the pads for use.

7 Claims, 5 Drawing Figures

Fig. 1.
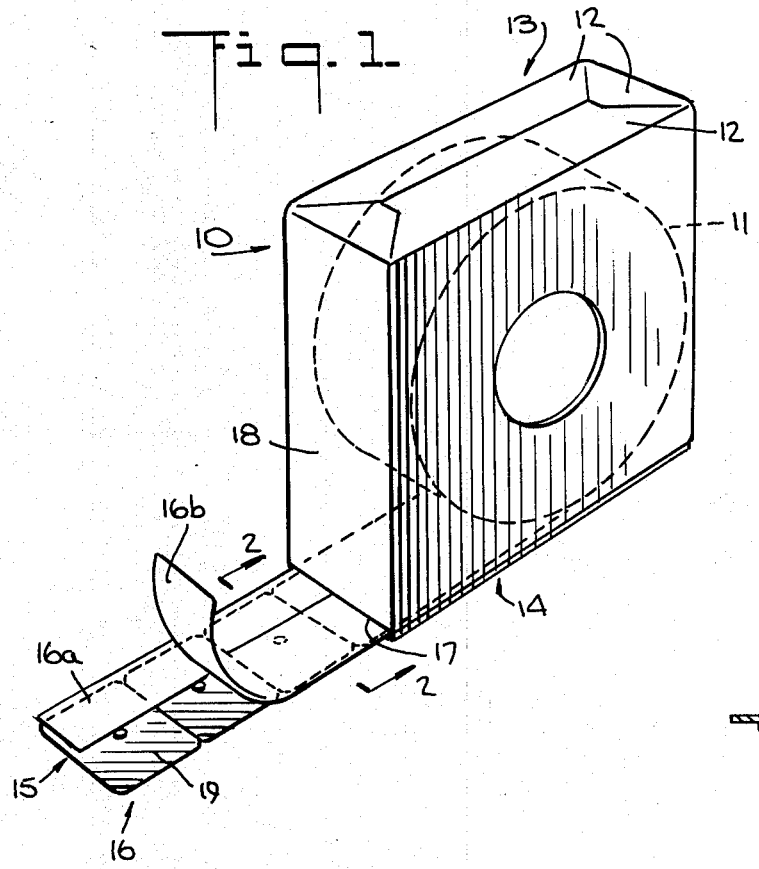
Fig. 3.
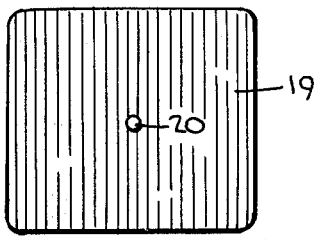
Fig. 2.
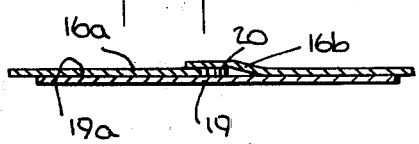
Fig. 4.
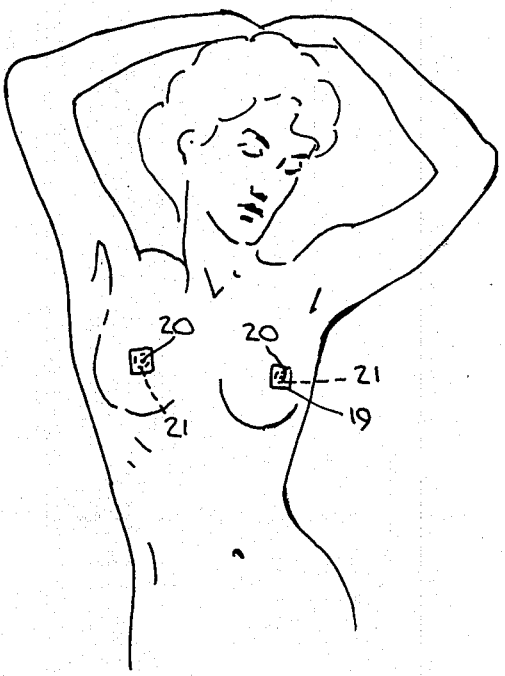
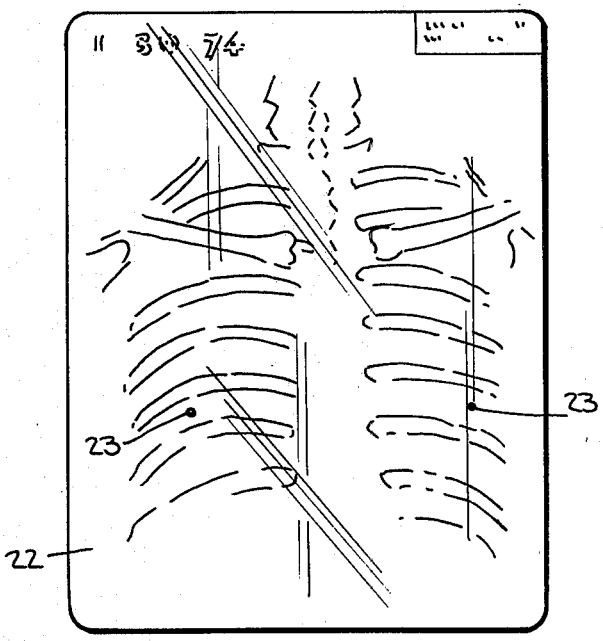
Fig. 5.

DISPENSING PACKAGE FOR NIPPLE MARKERS

BACKGROUND OF THE INVENTION

When taking chest X-rays it has been the practice of the technologist to cut small pieces from a thin lead sheet and then use adhesive tape so the person being X-rayed can tape the lead pieces over his or her nipples so that, when X-rayed, the nipples will be located on the negative by small white areas since the lead is opaque to X-rays. The purpose of identifying the nipple is so that the doctor examining the negative will not be misled by the otherwise shaded or darkened areas that are sometimes caused by the exposed nipples and thereby result in a misdiagnosis.

BRIEF SUMMARY OF THE INVENTION

The present invention provides a handy dispenser of pre-cut lead discs on adhesive pads to be used as nipple markers. The adhesive pads are releasably adhered to a paper tape wound into a roll which is rotatably housed in a box with its free end fed through a dispensing slit preferably located adjacent the bottom of the box. Tape sections, usually containing two pads, can be pulled through the slit and torn off from the rest of the roll, and the pads containing the lead discs can be peeled from the tape section for use.

Not only does such packaging increase efficiency in the X-ray room, but also it is more sanitary and more economical. Other objects and features of the invention will become apparent in the detailed description and in the drawing.

DESCRIPTION OF THE DRAWINGS

FIG. 1 is an isometric view of a dispensing container constructed in accordance with the principles of the present invention;

FIG. 2 is an enlarged section taken along lines 2—2 of FIG. 1;

FIG. 3 is an enlarged plan view of a pad with lead disc attached;

FIG. 4 is a schematic diagram of the upper torso of a female showing the pads and discs in place for an X-ray picture; and FIG. 5 is a schematic diagram of an X-ray showing the markers.

DETAILED DESCRIPTION

Referring now to the drawings, and in particular FIG. 1, the dispensing package is shown and designated generally by reference numeral 10. Package 10 can be constructed of any suitable material such as cardboard, heavy paper, plastic, or the like and may have any suitable shape, the requirement being that it provide a suitable housing for roll 11 shown in phantom with dotted lines. In the embodiment shown in FIG. 1, the package 10 is constructed from sheet material and folded into a generally rectangular box having overlapping and interengaging flap portions 12 at the top 13 and a similar construction on the bottom 14. The inner volume and dimensions of box 10 are sufficient to house tape 11 without substantial free or unoccupied space before any of the roll has been dispensed.

Roll 11 as shown is freely rotatable in box 10 without additional mounting means, although it is within the scope of the inventive concept to include a journal mount or rotatable tape supply means if desired.

The free end 15 of tape 16 extends through dispensing slit 17 at the bottom 14 of the front edge 18 of box 10. Tape 16 may be paper, or any readily severable material, and may be coated with wax or any similar composition to enhance its movement through slit 17 as well as to enhance release as will be described below. Tape 16 may be in two overlapping longitudinal strips **16*a*, 16*b*** as shown, or in one single unitary strip as desired.

Disposed on tape 16 are successive generally rectangular adhesive pads 19 each having adhered thereto, on the adhesive side **19*a*, a small lead disc 20 (see also FIGS. 2 and 3**). Any suitable other material opaque to X-rays may be used, but lead is the most readily available and manipulatable for the present purpose. The adhesive pads may be of any suitable, flexible material such as ordinary adhesive tape.

In use the free end 15 of tape 16 is manually pulled through dispensing slit 17 and torn off, usually in sections containing two pads 19, then handed to the patient or person to be X-rayed. The patient then removes the pads from the tape section and places each pad 19, containing the lead disc 20, over the nipples 21 as shown in FIG. 4. When the X-ray negative 22 is developed (FIG. 5), the discs 20 will cause white spots 23 on the negative to identify location of the nipples for the examining doctor.

As can be seen from the above description, a new and novel dispensing package is provided which is a substantial advance over prior practice. It results in a sanitary package that has easily dispensed, pre-cut nipple markers on pre-cut adhesive pads that are severable in paper tape sections that protect the disc and pad adhesive surface until removed by the patient for use. It saves time in the X-ray room and results in a more economic use of materials.

While one embodiment has been shown and described hereinabove, it is to be understood that changes and additions may be made by those skilled in the art without departing from the scope and spirit of the invention.

What is claimed is:

1. A dispensing package for nipple markers for use in chest X-ray procedures comprising tape supply means, an elongated base tape disposed in said supply means and dispensable therefrom, a plurality of flexible adhesive members releaseably adhered to said base tape, each such member having a nipple marker of a material substantially opaque to X-rays adhered thereto, each said member being manually removable from said base tape together with its respective nipple marker for releasable adherence to the human body.

2. A dispensing package for nipple markers for use in chest X-ray procedures comprising a housing having a dispensing opening therein, tape supply means mounted in said housing, an elongated base tape disposed in wound overlapped condition on said tape supply means and having an inner end secured to said tape supply means and an outer end extendable through said dispensing opening, a plurality of flexible adhesive members releasably adhered to said base tape, each such member having a nipple marker of a material substantially opaque to X-rays adhered thereto, said base tape containing said members and respective nipple markers dispensable through said dispensing opening under manual operation and each said member being manually releasable from said base tape together with its respective nipple marker for releasable adherence to the human body.

3. In the package of claim 2, said base tape being of a readily severable material for manual removal of successive portions thereof together with the adhesive members and associated nipple markers.

4. In the package of claim 3 said tape being a tearable paper having at least one surface having substantially reduced adhesive properties, said adhesive members and associated nipple markers being distributed along and in releasable engagement with said one surface.

5. In the package of claim 4, said one surface containing a coating of wax.

6. In the package of claim 5, said members being sections of adhesive tape.

7. In the package of claim 2, said nipple markers being composed substantially of lead and being of a size smaller than the average human nipple cross-sectional diameter.

* * * * *